US007337988B2

(12) United States Patent
McCormick et al.

(10) Patent No.: US 7,337,988 B2
(45) Date of Patent: Mar. 4, 2008

(54) REGULATING TURBINE FOR SPRINKLER

(75) Inventors: Chad McCormick, West Covina, CA (US); Jeff McKenzie, Lake Arrowhead, CA (US)

(73) Assignee: The Toro Company, Bloomington, MN (US)

( * ) Notice: Subject to any disclaimer, the term of this patent is extended or adjusted under 35 U.S.C. 154(b) by 366 days.

(21) Appl. No.: 10/959,650

(22) Filed: Oct. 5, 2004

(65) Prior Publication Data

US 2006/0071095 A1 Apr. 6, 2006

(51) Int. Cl.
*B05B 3/06* (2006.01)

(52) U.S. Cl. ..... 239/252; 239/233; 239/240; 239/256; 239/222.17; 239/223; 239/214.13; 239/258; 239/467

(58) Field of Classification Search ..... 239/233, 239/237, 240, 242, 251, 256, 263.3, 463, 239/466, 467, 222.17, 223, 224, 252, 200, 239/201, 210, 380, 382, 383, 214.13, 258; 415/151, 202, 64; 416/175, 128, 203
See application file for complete search history.

(56) References Cited

U.S. PATENT DOCUMENTS

| | | | | |
|---|---|---|---|---|
| 3,779,269 | A | 12/1973 | Gould | |
| 3,940,066 | A | 2/1976 | Hunter | |
| 4,026,471 | A * | 5/1977 | Hunter | 239/206 |
| 4,077,424 | A | 3/1978 | Ehret et al. | |
| 4,201,344 | A * | 5/1980 | Lichte | 239/242 |
| 4,624,412 | A | 11/1986 | Hunter | |
| 4,842,201 | A | 6/1989 | Hunter | |
| 4,986,474 | A | 1/1991 | Schisler et al. | |
| 4,989,786 | A * | 2/1991 | Kranzle et al. | 239/240 |
| 5,375,768 | A | 12/1994 | Clark | |
| 5,695,122 | A * | 12/1997 | Messinger | 239/240 |
| 5,758,827 | A * | 6/1998 | Van Le et al. | 239/242 |
| 5,984,203 | A | 11/1999 | Rosenberg | |
| 6,193,169 | B1 | 2/2001 | Steinhilber et al. | |
| 6,539,967 | B2 | 4/2003 | Tarr | |
| 2002/0162902 | A1 | 11/2002 | Kah | |
| 2003/0150935 | A1 * | 8/2003 | Renquist | 239/214 |

* cited by examiner

*Primary Examiner*—Dinh Q. Nguyen
(74) *Attorney, Agent, or Firm*—Inskeep IP Group, Inc.

(57) ABSTRACT

The present invention provides a turbine with dual sets of fins and a stator assembly for directing water onto both sets of fins. The water flow directed to the first set of fins generates slightly more force than the water flow directed to the second set of fins. In this manner, the opposing forces generated by the water flow maintain a more uniform and constant speed of the turbine.

20 Claims, 4 Drawing Sheets

REGULATING TURBINE FOR SPRINKLER

BACKGROUND OF THE INVENTION

The present invention relates to sprinklers and more specifically pertains to an improved turbine design for regulating the rotation speed of the sprinkler.

Sprinkler systems for turf irrigation are well known. Typical systems include a plurality of valves and sprinkler heads in fluid communication with a water source, and a centralized controller connected to the water valves. At appropriate times the controller opens the normally closed valves to allow water to flow from the water source to the sprinkler heads. Water then issues from the sprinkler heads in a predetermined fashion.

There are many different types of sprinkler heads, including above-the-ground heads and "pop-up" heads. Pop-up sprinklers, though generally more complicated and expensive than other types of sprinklers, are typically thought to be superior. There are several reasons for this. For example, a pop-up sprinkler's nozzle opening is typically covered when the sprinkler is not in use and is therefore less likely to be partially or completely plugged by debris or insects. Also, when not being used, a pop-up sprinkler is entirely below the surface and thus generally less obtrusive to the landscape.

The typical pop-up sprinkler head includes a stationary body and a "riser" which extends vertically upward, or "pops up" when water is allowed to flow to the sprinkler. Typically, the riser is a hollow tube which supports a nozzle at its upper end. When the normally-closed valve associated with a sprinkler opens to allow water to flow to the sprinkler, two things happen: (i) water pressure pushes against the riser to move it from its retracted to its fully extended position, and (ii) water flows axially upward through the riser, and the nozzle receives the axial flow from the riser and turns it radially to create a radial stream. A spring or other type of resilient element is interposed between the body and the riser to continuously urge the riser toward its retracted, subsurface, position, so that when water pressure is removed, the riser will immediately proceed from its extended to its retracted position.

The riser of a pop-up or above-the-ground sprinkler head can remain rotationally stationary or can include a portion that rotates in continuous or oscillatory fashion to water a circular or partly circular area, respectively. More specifically, the riser of the typical rotary sprinkler includes a first portion, which does not rotate, and a second portion, which rotates relative to the first (non-rotating) portion.

The rotating portion of a rotary sprinkler riser typically carries a nozzle at its uppermost end. The nozzle throws at least one water stream outwardly to one side of the nozzle assembly. As the nozzle assembly rotates, the water stream travels or sweeps over the ground.

The non-rotating portion of a rotary sprinkler riser typically includes a drive mechanism for rotating the nozzle. The drive mechanism generally includes a turbine and a transmission. The turbine is usually made with a series of angular vanes on a central rotating shaft that is actuated by a flow of fluid subject to pressure. The transmission consists of a reduction gear train that converts rotation of the turbine to rotation of the nozzle assembly at a speed slower than the speed of rotation of the turbine.

During use, as the initial inrush and pressurization of water enters the riser, it strikes against the vanes of the turbine causing rotation of the turbine and, in particular, the turbine shaft. Rotation of the turbine shaft, which extends into the drive housing, drives the reduction gear train that causes rotation of an output shaft located at the other end of the drive housing. Because the output shaft is attached to the nozzle assembly, the nozzle assembly is thereby rotated, but at a reduced speed that is determined by the amount of the reduction provided by the reduction gear train. An example of a nozzle assembly having this design can be seen in U.S. Pat. No. 4,681,260, which is herein incorporated by reference in its entirety.

With such sprinkler systems, a wide variation in fluid flow out of the nozzle can be obtained. If the system is subject to an increase in fluid flow rate through the riser, the speed of nozzle rotation increases proportionally due to the increased water velocity directed at the vanes of the turbine. In general, increases or decreases in nozzle speed then, of course, affect the desired water distribution.

Prior art sprinklers attempt to regulate the turbine speed by providing two water paths, one path leading to the turbine and another path bypassing the turbine. In typical designs of this type, pressure actuated valves divert a portion of the water around the turbine in an attempt to reduce the flow hitting the turbine, as seen in example U.S. Pat. Nos. 5,375,768 and 4,681,260, the contents of which are hereby incorporated by reference.

While the use of pressure actuated diversion valves within a sprinkler help regulate the water flow to the turbine, they become less than effective in extreme conditions, such as low flow or very high flow. For example, since such pressure valves only open at a certain pressure threshold such valves will not compensate for any fluctuations under that pressure threshold. In a similar manner, once the valve is completely open due to a relatively large water flow, such valves will not compensate for further fluctuations above a maximum pressure threshold.

Further, pressure activated valves can become maladjusted over time due to fatigue, wear, or even breakage. Replacement or repair of the valves can be difficult and costly.

As a result, there is a long felt need of a turbine rotation regulation device that is sensitive to changes in water flow pressure at any level, yet has an improved lifespan over prior designs.

OBJECTS AND SUMMARY OF THE INVENTION

It is an object of the present invention to provide an improved turbine-stator assembly which is better able to regulate the rotational speed of the turbine over a larger range of fluid flow.

It is a further object of the present invention to provide an improved turbine-stator assembly which has a longer lifespan and requires less frequent repair than prior art designs.

The present invention is believed to achieve these objects (and other objects not specifically enumerated herein) by providing a turbine with dual sets of fins and a stator assembly for directing water onto both sets of the fins. The water flow directed to the first set of fins generates slightly more force than the water flow directed to the second set of fins. In this manner, the opposing forces generated by the water flow maintain a more uniform and constant speed of the turbine.

DETAILED DESCRIPTION OF THE INVENTION

Figure 1:
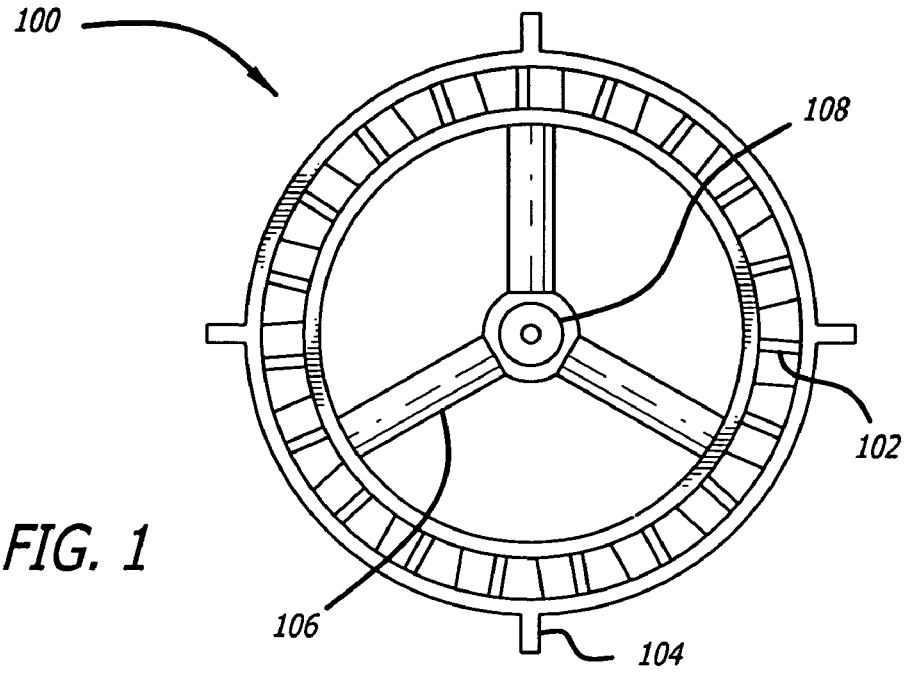
FIG. 1 illustrates a top view of a regulating turbine according to the present invention.
Figure 2:
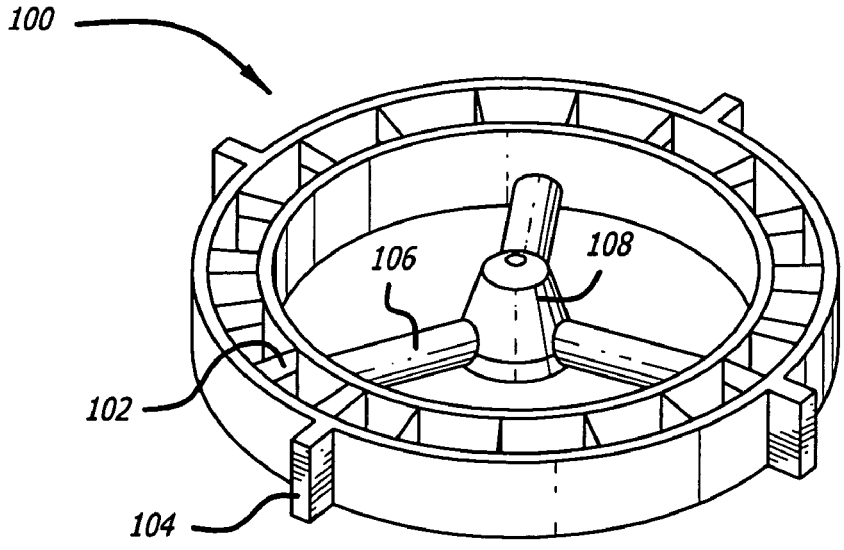
FIG. 2 illustrates a perspective view of the regulating turbine of FIG. 1.

Generally, a turbine of a sprinkler is positioned over a stator while being coupled to a rotational transmission responsible for causing the sprinkler head to rotate. As water enters the sprinkler, the stator directs the water to the turbine, causing the turbine to rotate. Thus, the turning turbine drives the sprinkler transmission and the rotating sprinkler head. An example of such an arrangement is shown and discussed in U.S. Pat. Nos. 5,720,435 and 5,375,768, which are incorporated herein by reference. Since turf irrigation highly prefers constant rotational velocity of the sprinkler head, it remains important to regulate the rotational speed of the turbine.

Prior art sprinklers have relied on various stator designs in an attempt to regulate turbine speed. However, such prior art designs typically did not hold the rotation speed of the turbine to remain substantially constant during wide variations in fluid flow.

Looking to FIGS. 1-3C and 5, a regulating turbine 100 and stator 110 of a sprinkler 101 are illustrated according to the present invention. The regulating turbine 100 includes drive fins 102 to drive rotation of the regulating turbine 100 and brake fins 104 mounted on the external circumference of the turbine 100 to provide opposing forces to drive fins 102. As water flow increases or decreases, the fins 102 and 104 provide the same overall ratio of rotational force on the regulating turbine 100, thus resulting in a generally constant rotational speed of the regulating turbine 100.

The regulating turbine 100 preferably has a plurality of drive fins 102 disposed around an inner diameter of the regulating turbine 100. Each of these drive fins 102 are angled to provide rotational force derived from a stream of water directed towards it. Around the outer diameter of the regulating turbine 100 are braking fins 104, aligned longitudinally along the axis of the regulating turbine 100. As a result, when rotating, these braking fins 104 create a smaller but oppositely directed force to that produced by the drive fins 102.

Figure 5:
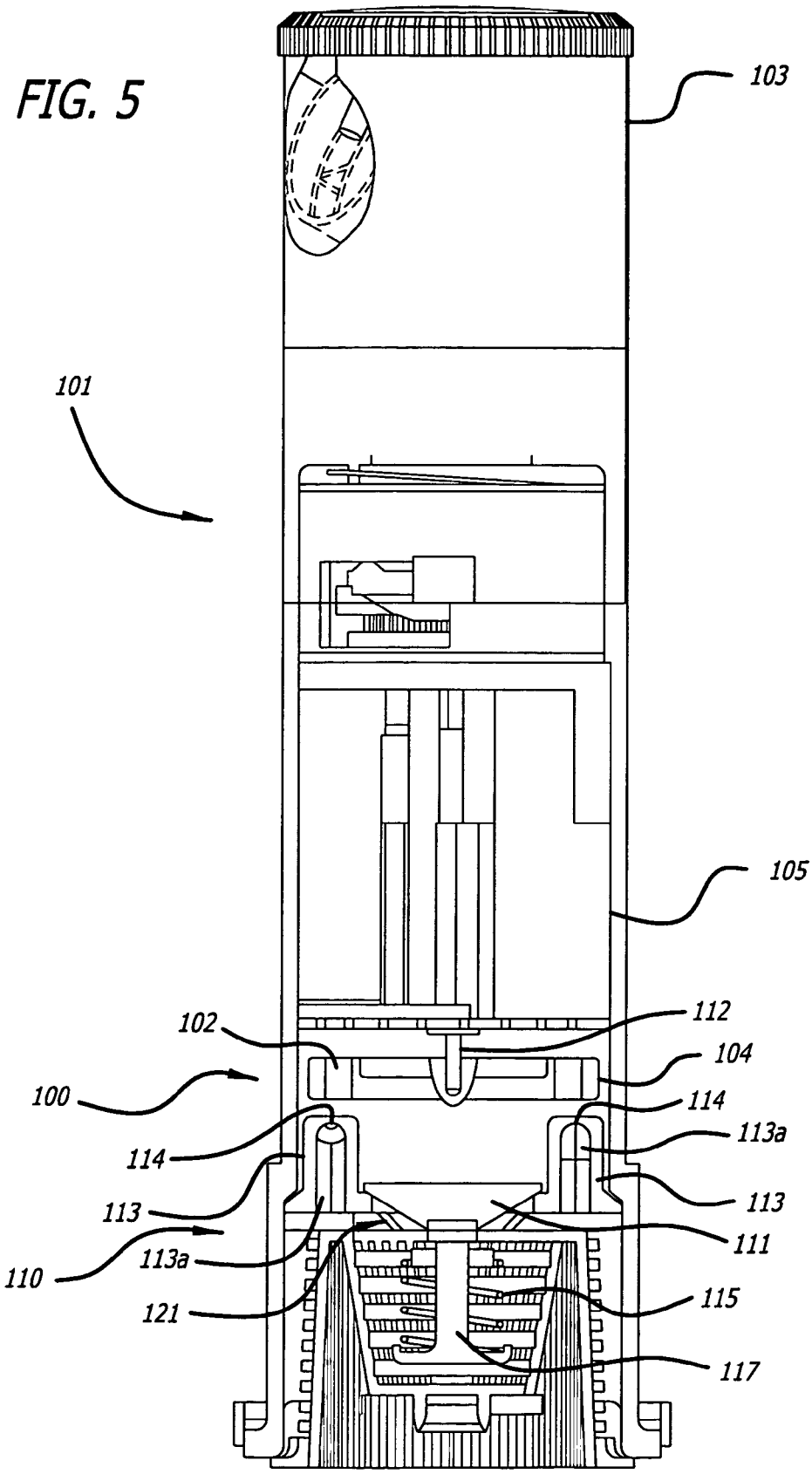
FIG. 5 illustrates a side view of a sprinkler with a regulating turbine according to the present invention.

As seen best in FIG. 5, the regulating turbine 100 is positioned above a stator 110 which directs oncoming water to the turbine 100. Both the turbine 100 and the stator 110 are preferably located in a lower region of the sprinkler 101, below the sprinkler head 103 and transmission 105. A shaft mount 108 is positioned in the center of regulating turbine 100 by struts 106, mounting to sprinkler transmission shaft 112. The sprinkler transmission shaft 112 in turn couples to the sprinkler transmission 105 which ultimately drives the sprinkler head 103.

Figure 3A:
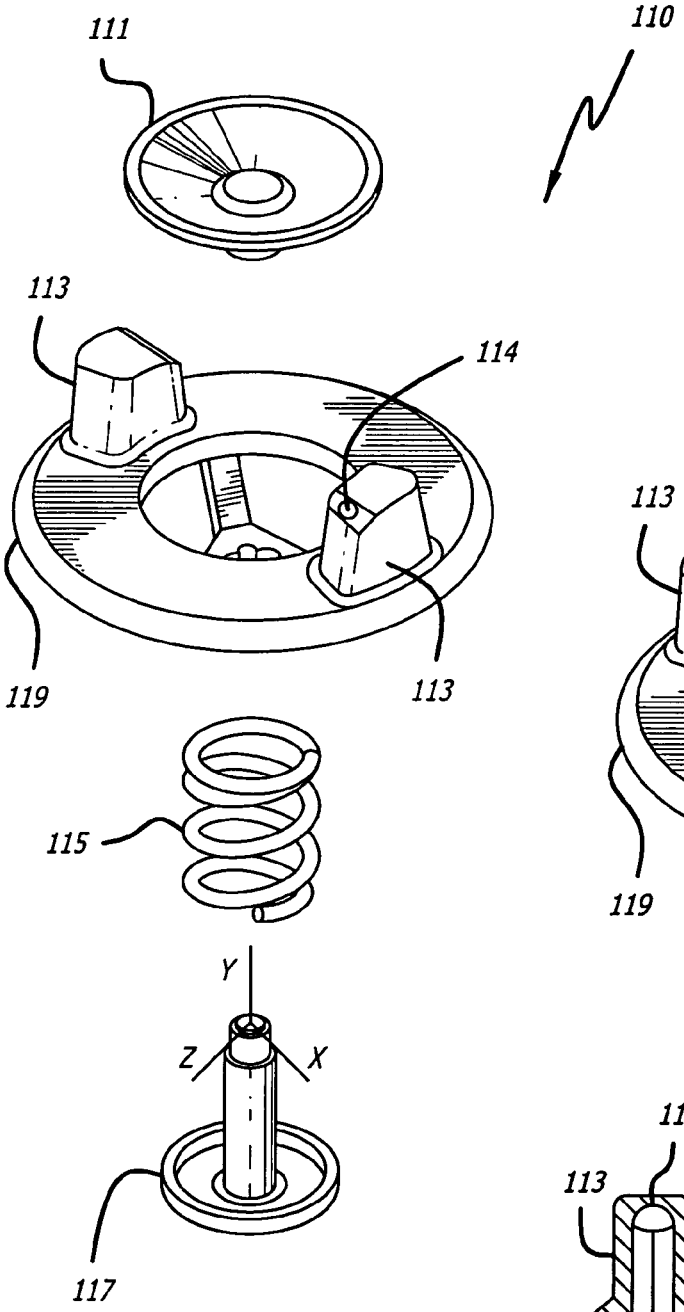
FIG. 3A-3C illustrates various views of a stator assembly according to the present invention.
Figure 3B:
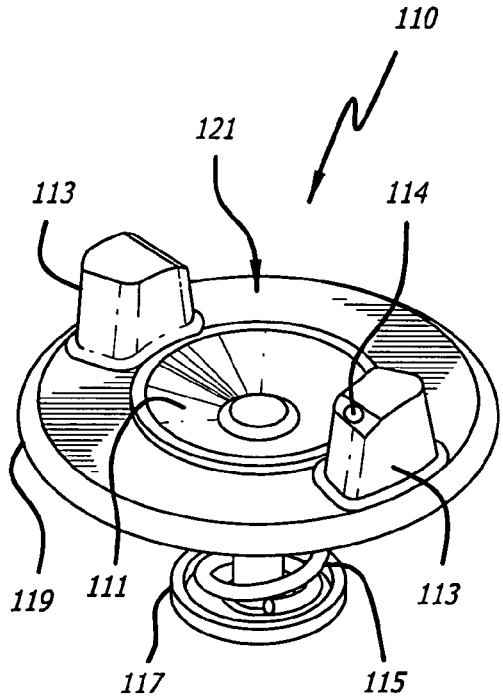
Figure 3C:
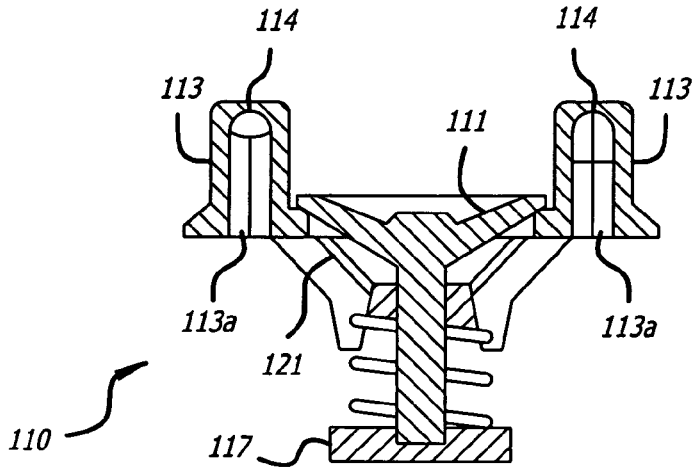

As seen in FIGS. 3A-3C, the stator 110 is composed of a stator base 119, having an overall disk-shape with a center aperture. Two protrusions 113 extend from the surface of the stator base 119, enclosing a channel 113*a* with a water port 114 at the end. A bypass valve member 111 is positioned within the aperture of the stator base 119 and is further connected to valve stem 117, creating a bypass valve 121. A spring 115 is positioned to press against a lower area of the stator base 119 and valve stem 117 so as to bias the bypass valve member 111 to a sealed or closed position.

Water flows against the stator 110, moving up channels 113*a* and out water ports 114. While the relationship of the turbine fins 102 and 104 are constant, the flow path from the water ports 114 and the bypass valve 121 are variable, depending on the water flow. At low flow rates, most of the water flows through the water ports 114 and contacts the drive fins 102, while very little water escapes from the bypass valve 121 to contact the braking fins 104. At higher flow rates, the water not only flows through the water ports 114 at a greater rate, but also forces the bypass valve member 111 upward, opening up the bypass valve 121. The angled design of the bypass valve member 111 directs water radially outwards from the center, towards the brake fins 104. Thus, the bypass valve member 111 changes the proportion of water directed at the turbine from mostly aimed at the drive fins 102 at lower flow, to mostly aimed at the braking fins 104 at a higher flow. Since the water is less efficiently directed at the braking fins, since there are fewer braking fins 104 than drive fins 102, and since the braking fins 104 include less of an angle than the drive fins 102, the rotation of the regulating turbine 100 remains substantially constant.

For example, the water ports 114 preferably have a diameter of 0.109 inches, which allows the bypass valve 121 to open when the water flow reaches about 10 GPM. At 10 GPM, little if any water passes through the aperture bypass valve 121 since it is still substantially blocked by bypass valve member 111. Thus the breaking fins 104 have a minimal breaking effect on the regulating turbine 100 since they contact a small amount of water.

When the initial water flow reaches about 12 GPM, the flow from the water ports 114 remains at about 10 GPM while the bypass valve 121 allows about 2 GPM or about 20% of the total water flow through. As the total initial water flow increases above about 12 GPM, the amount of water that passes through the bypass valve 121 also increases, and is thus directed towards the braking fins 104. In this respect, the force applied to the breaking fins 104 is proportional to the ratio between the flow of the bypassed water to the flow of the drive water from water ports 114.

The rotational speed of the regulating turbine may be adjusted or varied according to the user's preference by, for example, varying the size and angle of drive fin 102, varying the size and angle of brake fin 104, and varying the size of water port 114. In a preferred embodiment, the angle of the drive fins 102 are 45 degrees and the angle of the braking fins 104 are 5 degrees.

Figure 4:
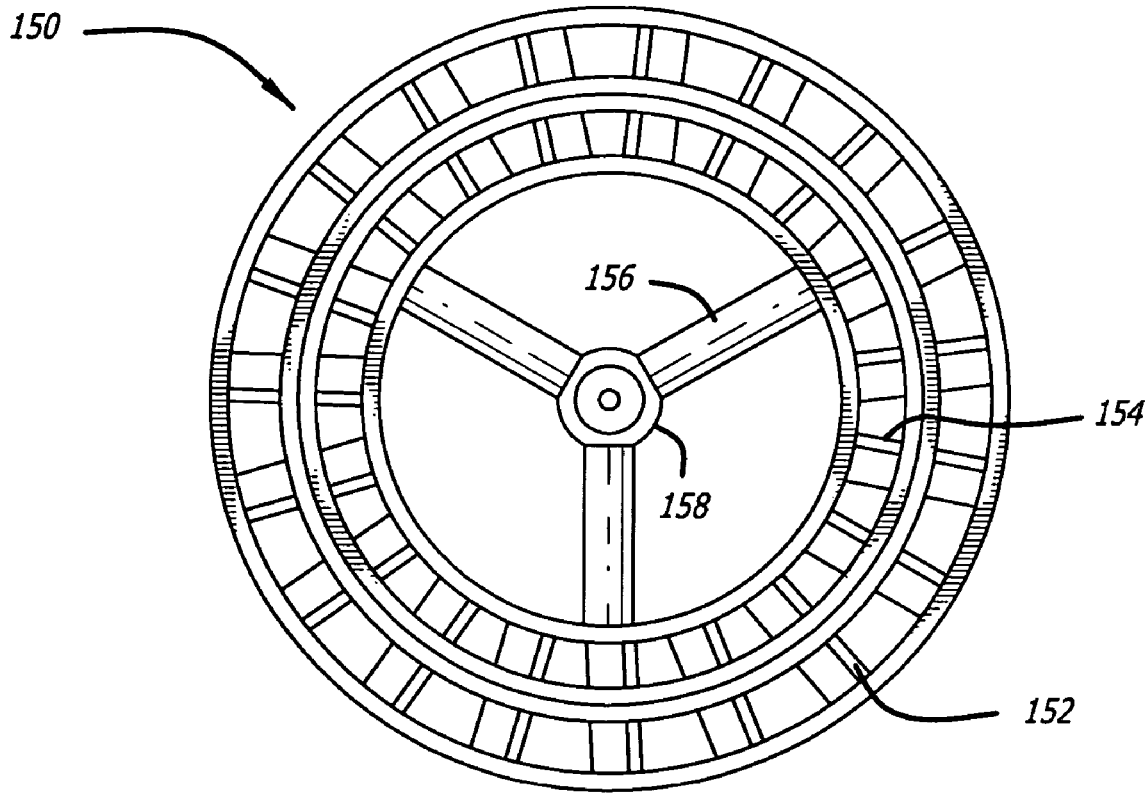
FIG. 4 illustrates a top view of a regulating turbine according to the present invention.

FIG. 4 illustrates an alternative preferred embodiment of a regulating turbine 150 according to the present invention. As with the previously described embodiment, the regulating turbine 150 includes drive fins 154 with a center shaft mount 158 held in place by struts 156. However, the regulating turbine 150 includes multiple angled brake fins 152 disposed around an outer diameter of the regulating turbine 150. By increasing the number of brake fins 152 and fixing them at an angle at least somewhat opposite to the drive fins 154, additional braking force may be created. For example, in this embodiment the angle of each drive fin 154 may be 45 degrees and the angle of each brake fin 152 may be 5 degrees.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A sprinkler for distributing water from a source over an area of terrain comprising:

a housing having an inlet connected by a passage to an outlet;

a sprinkler head mounted on said housing at said outlet for rotation about an axis for distribution of water via a nozzle;

a turbine rotatably positioned within said passage and operatively connected for driving said sprinkler head, said turbine having a first set of fins and a second set of fins; said first set of fins disposed on said turbine so as to urge rotation of said turbine in a first direction and said second set of fins disposed on said turbine so as to urge rotation of said turbine in a second direction, said second direction being opposite said first direction, and a stator assembly positioned and shaped to direct water flow to said first set of fins and said second set of fins.

2. The sprinkler of claim 1 wherein said first set of fins are positioned at opposing angles relative to said second set of fins.

3. The sprinkler of claim 1 wherein said first set of fins are angled relative to an axis of rotation of said turbine.

4. The sprinkler of claim 1 wherein:

said first set of fins are angled relative to an axis of rotation of said turbine; and said second set of fins are parallel relative to an axis of rotation of said turbine.

5. The sprinkler of claim 1 wherein said stator includes a water port for directing water to said first set of fins.

6. An irrigation sprinkler comprising:

a sprinkler housing having an inner passage;

a turbine rotatably coupled within said inner passage;

a first set of fins disposed on said turbine, said first set of fins oriented to generate a primary rotational force on said turbine;

a second set of fins disposed on said turbine, said second set of fins oriented to generate a secondary opposing rotational force on said turbine;

a stator positioned within said inner passage to direct water to said first set of fins on said turbine and said second set of fins on said turbine.

7. The irrigation sprinkler of claim 6 wherein said first set of fins are positioned at an angle relative to an axis of rotation of said turbine.

8. The irrigation sprinkler of claim 6 wherein said first set of fins are positioned at opposing angles relative to said second set of fins.

9. The irrigation sprinkler of claim 6 wherein:

said first set of fins are angled relative to an axis of rotation of said turbine; and said second set of fins are parallel relative to an axis of rotation of said turbine.

10. The irrigation sprinkler of claim 6 wherein said second set of fins are disposed on an outer circumference of said turbine.

11. The irrigation sprinkler of claim 6 wherein said second set of fins further comprises 4 fins.

12. The irrigation sprinkler of claim 6 wherein said first set of fins have an angle relative to an axis of rotation of said turbine of 45 degrees.

13. The irrigation sprinkler of claim 6 wherein said second set of fins have an angle relative to an axis of rotation of said turbine of 5 degrees.

14. A method of regulating turbine velocity comprising:

providing a sprinkler housing having a turbine rotatably connected within said sprinkler housing, said turbine having a first set of fins and a second set of fins;

directing a first flow of water against said first set of fins so as to create a primary rotational force on said turbine; and directing a second flow of water against said second set of fins so as to create an opposing rotational force on said turbine, wherein said opposing rotational force is smaller than said primary rotational force.

15. The method according to claim 14, wherein the directing of said first and said second flow of water includes dividing an initial flow of water through a stator into said first and second flow of water.

16. The method according to claim 14, wherein the directing of said first flow includes directing water against fins angled relative to an axis of said turbine.

17. The method according to claim 14, wherein the directing of said second flow includes directing water against fins substantially parallel to an axis of said turbine.

18. The method according to claim 14, the directing of said first flow and the directing of said second flow includes directing water at fins angled opposite to each other relative to an axis of said turbine.

19. The method according to claim 14, wherein said directing of said first flow includes directing water to an internal circumference of said turbine.

20. The method according to claim 14, wherein said directing of said second flow includes directing water to an external circumference of said turbine.

* * * * *